US010408525B2

(12) United States Patent
Shin et al.

(10) Patent No.: US 10,408,525 B2
(45) Date of Patent: Sep. 10, 2019

(54) DEFROSTING DEVICE AND REFRIGERATOR HAVING THE SAME

(71) Applicant: LG ELECTRONICS INC., Seoul (KR)

(72) Inventors: Youngjae Shin, Seoul (KR); Kwangsoo Jung, Seoul (KR); Woocheol Kang, Seoul (KR); Geunhyung Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 122 days.

(21) Appl. No.: 15/348,058

(22) Filed: Nov. 10, 2016

(65) Prior Publication Data

US 2017/0131018 A1 May 11, 2017

(30) Foreign Application Priority Data

Nov. 11, 2015 (KR) ..... 10-2015-0158325

(51) Int. Cl.
*F25D 21/06* (2006.01)
*F25D 21/08* (2006.01)
(Continued)

(52) U.S. Cl.
CPC ..... *F25D 21/06* (2013.01); *F25D 21/08* (2013.01); *F25D 21/065* (2013.01); *F25D 21/10* (2013.01); *F25D 21/12* (2013.01); *F25D 21/125* (2013.01)

(58) Field of Classification Search
CPC ..... F25D 21/065; F25D 21/10; F25D 21/12; F25D 21/125
See application file for complete search history.

(56) References Cited

U.S. PATENT DOCUMENTS 2,631,442 A 3/1953 Cyril
4,152,900 A * 5/1979 Chopra ..... F25D 21/08 219/200
(Continued)

FOREIGN PATENT DOCUMENTS

JP H08303932 11/1996
JP H08313144 11/1996
(Continued)

OTHER PUBLICATIONS

International Search Report and Written Opinion in International Application No. PCT/KR2016/012650, dated Jan. 6, 2017, 15 pages (with English translation).
(Continued)

*Primary Examiner* — Filip Zec
(74) *Attorney, Agent, or Firm* — Fish & Richardson P.C.

(57) ABSTRACT

The present disclosure discloses a defrosting device, including a heating unit provided at a lower side of an evaporator, and configured to heat working fluid therein; and a plurality of heat pipes, both end portions of which are connected to an inlet and an outlet of the heating unit, respectively, and at least part of which are disposed adjacent to a cooling tube of the evaporator to emit heat to the cooling tube due to high temperature working fluid heated and transferred by the heating unit, wherein the plurality of heat pipes are configured with a first heat pipe and a second heat pipe disposed to form two rows on a front portion and a rear portion of the evaporator, respectively, and the first heat pipe and the second heat pipe are formed in different lengths.

16 Claims, 10 Drawing Sheets

(51) Int. Cl.
*F25D 21/12* (2006.01)
*F25D 21/10* (2006.01)

(56) References Cited

U.S. PATENT DOCUMENTS

| | | | | |
|---|---|---|---|---|
| 4,369,350 | A * | 1/1983 | Kobayashi | F25D 21/08 219/201 |
| 6,230,511 | B1 | 5/2001 | Lee et al. | |
| 6,378,204 | B1 * | 4/2002 | Kim | B21D 53/085 29/890.043 |
| 6,626,004 | B2 * | 9/2003 | Lee | F25D 21/08 392/480 |
| 7,028,499 | B2 * | 4/2006 | Kwon | F25B 47/022 62/276 |
| 8,438,866 | B2 * | 5/2013 | Kim | F25D 17/045 62/151 |
| 8,931,296 | B2 * | 1/2015 | Petrenko | F24D 19/0095 62/276 |
| 2011/0073586 | A1 | 3/2011 | Lim et al. | |
| 2012/0096887 | A1 * | 4/2012 | Cho | F25D 17/065 62/276 |

FOREIGN PATENT DOCUMENTS

| | | |
|---|---|---|
| KR | 20030068931 | 8/2003 |
| KR | 101036685 | 5/2011 |
| KR | 20130008864 | 1/2013 |

OTHER PUBLICATIONS

Extended European Search Report in European Application No. 16864517.4, dated May 15, 2019, 8 pages.

* cited by examiner

DEFROSTING DEVICE AND REFRIGERATOR HAVING THE SAME

CROSS-REFERENCE TO RELATED APPLICATIONS

Pursuant to 35 U.S.C. § 119(a), this application claims the benefit of earlier filing date and right of priority to Korean Application No. 10-2015-0158325, filed on Nov. 11, 2015, the contents of which is incorporated by reference herein in its entirety.

BACKGROUND OF THE INVENTION

1. Field of the Invention

The present disclosure relates to a defrosting device for removing frost formed on an evaporator provided in a refrigeration cycle, and a refrigerator having the same.

2. Description of the Related Art

An evaporator provided in a refrigeration cycle decreases ambient temperature using cool air generated by the circulation of coolant flowing through a cooling tube. During the process, when there occurs a temperature difference from ambient air, a phenomenon of condensing and freezing moisture in the air on a surface of the cooling tube occurs.

A defrosting method using an electric heater has been used for a defrosting process for removing frost formed on an evaporator in the related art.

In recent years, a defrosting device using a heat pipe has been developed and contrived, and the related technologies include Korean Patent Registration No. 10-0469322, entitled "Evaporator."

In a heat pipe type defrosting device, working fluid heated by a heating unit is configured to circulate a heat pipe, and heat emission is carried out on a cooling tube during the circulation process of working fluid. Due to the flow of the working fluid, as working fluid transfers heat to the cooling tube, temperature may gradually decrease, and thus defrosting may not be efficiently carried out for a lower cooling tube.

In particular, considering that frost is mostly formed at a front side of the evaporator due to the flow of cool air, increasing the temperature of the heat pipe may be an important issue in defrosting reliability.

SUMMARY OF THE INVENTION

An aspect of the present disclosure is to provide a defrosting device capable of increasing the entire temperature of the heat pipe to perform efficient defrosting.

Another aspect of the present disclosure is to provide a defrosting device capable of transferring more heat to a first heat pipe disposed at a front portion of the evaporator, considering that frost is mostly formed at a front side of the evaporator due to the flow of cool air.

In order to accomplish the foregoing tasks of the present disclosure, a defrosting device according to the present disclosure may include a heating unit provided at a lower side of an evaporator, and configured to heat working fluid therein; and a plurality of heat pipes, both end portions of which are connected to an inlet and an outlet of the heating unit, respectively, and at least part of which are disposed adjacent to a cooling tube of the evaporator to emit heat to the cooling tube due to high temperature working fluid heated and transferred by the heating unit, wherein the plurality of heat pipes are configured with a first heat pipe and a second heat pipe disposed to form two rows on a front portion and a rear portion of the evaporator, respectively, and the first heat pipe and the second heat pipe are formed in different lengths.

The first and the second heat pipe may be repeatedly bent in a zigzag shape, respectively, to form a plurality of columns, and the first heat pipe and the second heat pipe may be configured to have different total numbers of columns.

The present disclosure discloses a first and a second embodiment of the first and the second heat pipe provided in the defrosting device.

First Embodiment:

A total number of columns of the second heat pipe may be configured to be less than that of the first heat pipe.

For an example, the highest and the lowest column of the second heat pipe may be disposed to correspond to the highest and the lowest column of the first heat pipe, respectively, and a distance between two columns adjacent to each other on the second heat pipe may be larger than that between two columns adjacent to each other on the first heat pipe.

For another example, the highest column of the second heat pipe may be disposed to be lower than the highest column of the first heat pipe, and a distance between two columns adjacent to each other on the second heat pipe may be configured to correspond to that between two columns adjacent to each other on the first heat pipe.

Second Embodiment:

A total number columns of the first heat pipe may be configured to be less than that of the second heat pipe.

For an example, the highest and the lowest column of the first heat pipe may be disposed to correspond to the highest and the lowest column of the second heat pipe, respectively, and a distance between two columns adjacent to each other on the first heat pipe may be larger than that between two columns adjacent to each other on the second heat pipe.

For another example, the highest column of the first heat pipe may be disposed to be lower than the highest column of the second heat pipe, and a distance between two columns adjacent to each other on the first heat pipe may be configured to correspond to that between two columns adjacent to each other on the second heat pipe.

Moreover, the present disclosure discloses a first and a second embodiment of a heating unit provided in the defrosting device.

First Embodiment:

The heating unit may include a heater case provided with a vacant space therein, and provided with the inlet and the outlet, respectively, at positions separated from each other along a length direction; and a heater attached to an outer surface of the heater case to heat working fluid within the heater case.

The heater may include a base plate formed of a ceramic material, and attached to an outer surface of the heater case; a heating element formed on the base plate, and configured to emit heat during the application of power; and a terminal provided on the base plate to electrically connect the heating element to the power.

The heater case may be partitioned into an active heating part corresponding to a portion on which the heating element is disposed and a passive heating part corresponding to a portion on which the heating element is not disposed, and the inlet may be formed on the passive heating part to prevent working fluid moving through the heat pipe and then returning through the inlet from being reheated and flowing backward.

The heater may be attached to a bottom surface of the heater case, and a first and a second extension fin extended from the bottom surface in a downward direction to cover both sides of the heater attached to the bottom surface may be provided at both sides of the heater case, respectively.

A sealing member may be filled into a recessed space formed by a rear surface of the heater and the first and the second extension fin to cover the heater, and an insulating material may be interposed between the rear surface of the heater and the sealing member.

Second Embodiment:

The heating unit may include a heater case provided with a vacant space therein, and provided with the inlet and the outlet, respectively, at positions separated from each other along a length direction; and a heater having an active heating part accommodated in the heater case to actively generate heat so as to heat working fluid, and a passive heating part extended from the active heating part to be heated at a temperature lower than that of the active heating part, wherein the inlet is formed at a position facing the passive heating part on an outer circumference of the heater case to introduce working fluid moving through the heat pipe and then returning into a space between the heater case and the passive heating part.

In addition, the present disclosure discloses a refrigerator, including a refrigerator body; an evaporator provided within the refrigerator to absorb ambient heat as the heat of vaporization to perform a cooling function; and a defrosting device configured to remove frost generated on the evaporator.

According to the present disclosure, either one of the first and the second heat pipe should be formed to be shorter than the other one thereof, and thus the entire path through which working fluid circulates may be shorter, thereby increasing the temperatures of the first and the second heat pipe as a whole. As a result, it may be possible to enhance defrost performance.

A total number of columns of the second heat pipe disposed on a rear portion of the evaporator may be configured to be less than that of the first heat pipe disposed on a front portion of the evaporator, considering that frost is mostly formed at a front side of the evaporator due to the flow of cool air. According to this, a path through which working fluid (F) circulates may be shorter to increase the temperature of the first and the second heat pipe as a whole, and a total number of columns of the first heat pipe may be provided to be larger than that of the second heat pipe, thereby transferring more heat through the first heat pipe.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Hereinafter, a defrosting device and a refrigerator having the same associated with the present disclosure will be described in more detail with reference to the accompanying drawings.

According to the present specification, the same or similar elements are designated with the same numeral references even in different embodiments and their redundant description will be omitted.

Furthermore, a structure applied to any one embodiment may be also applied in the same manner to another embodiment if they do not structurally or functionally contradict each other even in different embodiments.

A singular representation may include a plural representation as far as it represents a definitely different meaning from the context.

In describing the embodiments disclosed herein, moreover, the detailed description will be omitted when a specific description for publicly known technologies to which the invention pertains is judged to obscure the gist of the present invention.

The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

Figure 1:
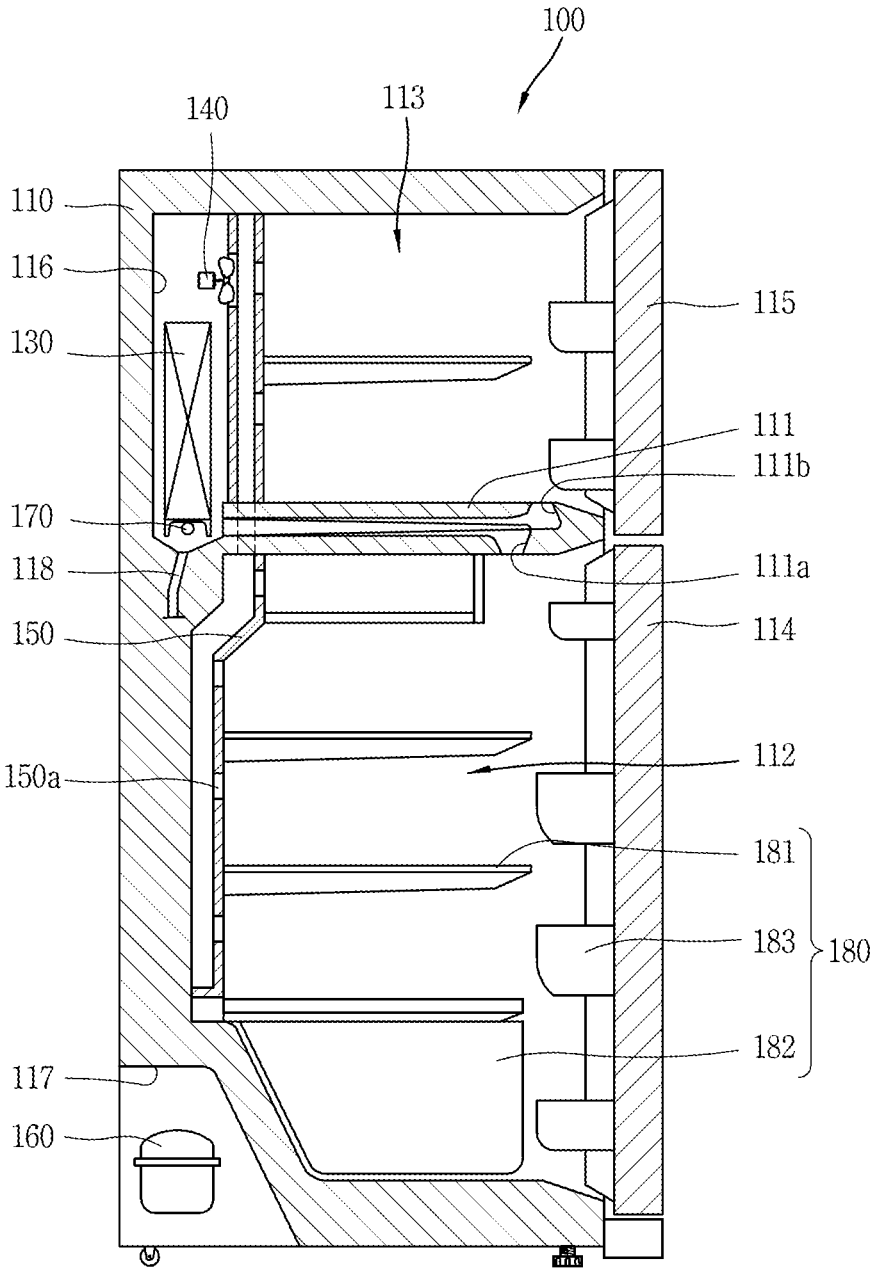
FIG. 1 is a longitudinal cross-sectional view schematically illustrating the configuration of a refrigerator according to an embodiment of the present disclosure.

FIG. 1 is a longitudinal cross-sectional view schematically illustrating the configuration of a refrigerator 100 according to an embodiment of the present disclosure.

The refrigerator 100 is a device for storing foods kept therein at low temperatures using cooling air generated by a less in which the processes of compression-condensation-expansion-evaporation are sequentially carried out.

As illustrated in the drawing, a refrigerator body 110 may include a storage space for storing foods therein. The storage space may be separated by a partition wall 111, and divided into a refrigerating chamber 112 and a freezing chamber 113 according to the set temperature.

According to the embodiment, a top mount type refrigerator in which the freezing chamber 113 is disposed on the refrigerating chamber 112, but the present disclosure may not be necessarily limited to this. The present disclosure may be applicable to a side by side type refrigerator in which the refrigerating chamber and freezing chamber are horizontally disposed, a bottom freezer type refrigerator in which the refrigerating chamber is provided at the top and the freezing chamber is provided at the bottom, and the like.

A door is connected to the refrigerator body 110 to open or close a front opening portion of the refrigerator body 110. According to the present drawing, it is illustrated that a refrigerating chamber door 114 and a freezing chamber door 115 are configured to open or close a front portion of the refrigerating chamber 112 and freezing chamber 113, respectively. The door may be configured in various ways, such as a rotation type door in which a door is rotatably connected to the refrigerator body 110, a drawer type door in which a door is slidably connected to the refrigerator body 110, and the like.

The refrigerator body 110 may include at least one of accommodation units 180 (for example, a shelf 181, a tray 182, a basket 183, etc.) for effectively using an internal storage space. For example, the shelf 181 and tray 182 may be installed within the refrigerator body 110, and the basket 183 may be installed at an inside of the door 114 connected to the refrigerator body 110.

On the other hand, a machine room 117 is provided in the refrigerator body 110, and a compressor 160, a condenser (not shown) and the like are provided within the machine room 117. The compressor 160 and the condenser are connected to an evaporator 130 provided in the cooling chamber 113 to constitute a refrigeration cycle. Refrigerant circulating the refrigeration cycle absorbs ambient heat as the heat of vaporization, thereby allowing the surroundings to obtain a cooling effect.

A refrigerating chamber return duct 111*a* and a freezing chamber return duct 111*b* for inhaling and returning the air of the refrigerating chamber 112 and freezing chamber 113 to the side of the cooling chamber 116 are formed on the partition wall 111. Furthermore, a cool air duct 150 communicating with the freezing chamber 113 and having a plurality of cool air discharge ports 150*a* on a front portion thereof is installed at a rear side of the refrigerating chamber 112.

On the other hand, the process of inhaling the air of the refrigerating chamber 112 and freezing chamber 113 to the cooling chamber 116 through the refrigerating chamber return duct 111*a* and freezing chamber return duct 111*b* of the partition wall 111 by the blower fan 140 of the cooling chamber 116 to perform heat exchange with the evaporator 130, and discharging it to the refrigerating chamber 112 and freezing chamber 113 through the cool air discharge ports 150*a* of the cool air duct 150 again is repeatedly carried out. At this time, frost is formed on a surface of the evaporator 130 due to a temperature difference from circulation air reintroduced through the refrigerating chamber return duct 111*a* and the freezing chamber return duct 111*b*.

A defrosting device 170 is provided in the evaporator 130 to remove such frost, and water removed by the defrosting device 170, namely, defrost water, is collected to a lower defrost water tray (not shown) of the refrigerator body 110 through a defrost water discharge pipe 118.

Hereinafter, a new type of defrosting device 170 capable of reducing power consumption and enhancing heat exchange efficiency during defrost will be described.

Figure 2:
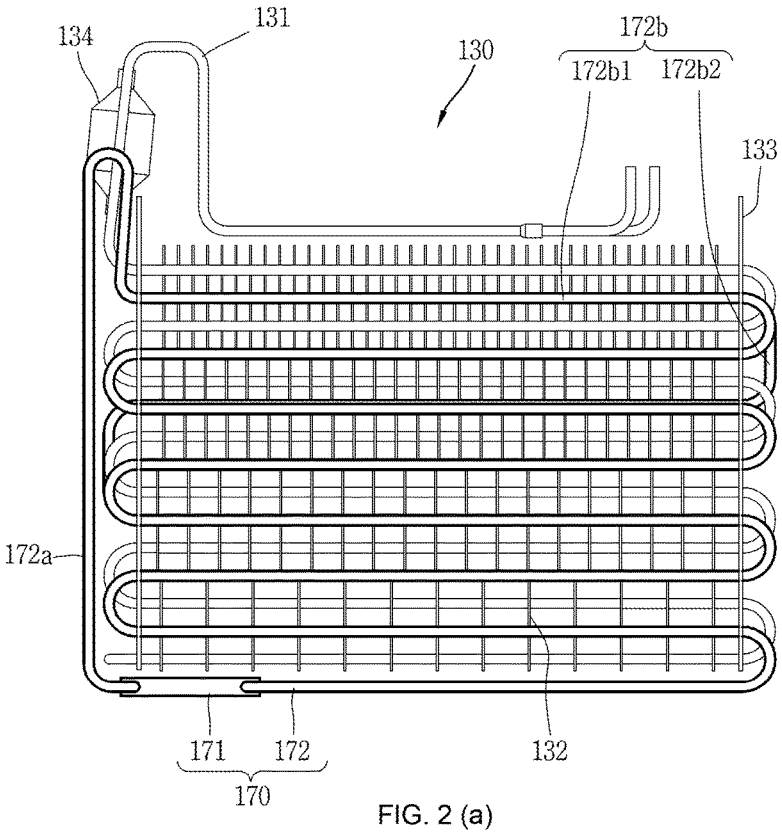
FIG. 2(*a*) and FIG. 2(*b*) are diagrams illustrating an example evaporator applied to the refrigerator of FIG. 1.
Figure 2:
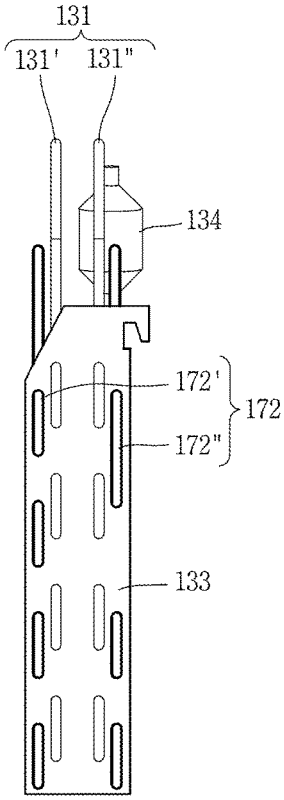
Figure 3:
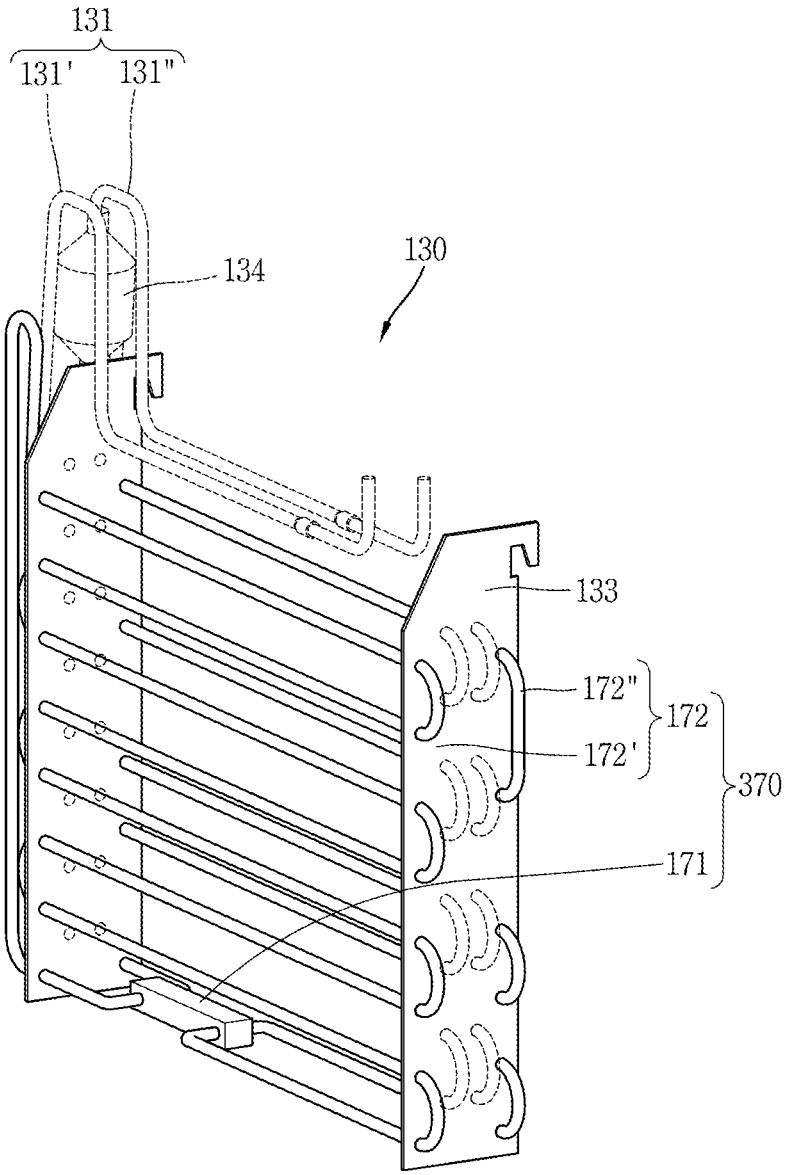
FIG. 3 is a conceptual view illustrating the layout of a first heat pipe and a second heat pipe in an evaporator illustrated in FIG. 2.

FIG. 2 is a front view (a) and a side view (b) illustrating a first embodiment of an evaporator applied to the refrigerator of FIG. 1, and FIG. 3 is a conceptual view illustrating the layout of a first heat pipe and a second heat pipe in an evaporator illustrated in FIG. 2.

For reference, part of a second heat pipe 172" overlaps with a first heat pipe 172' and thus not seen in FIG. 2(*a*), but referring to FIG. 3, the entire shape of the second heat pipe 172" is seen. In order to facilitate understanding, it is illustrated in FIG. 3 that part of the first cooling tube 131' and second cooling tube 131" is omitted.

Referring to FIGS. 2(*a*), 2(*b*), and 3, the evaporator 130 may include a cooling tube 131 (cooling pipe), a plurality of cooling fins 132, and support fixtures 133 at both sides.

The cooling tube 131 is repeatedly bent in a zigzag shape to constitute a plurality of columns, and refrigerant is filled therein. The cooling tube 131 may be formed in an aluminum material.

The cooling tube 131 may be configured in combination with horizontal pipe portions and bending pipe portions. The horizontal pipe portions are horizontally disposed to each other in a vertical direction, and configured to pass through the cooling fins 132, and the bending pipe portions couples an end portion of an upper horizontal pipe portion to an end portion of a lower horizontal pipe portion to communicate their inner portions with each other.

The cooling tube 131 is supported through the support fixture 133 provided at both sides of the evaporator 130. Here, the bending pipe portion of the cooling tube 131 is configured to couple an end portion of an upper horizontal pipe portion to an end portion of a lower horizontal pipe portion at an outer side of the support fixture 133.

According to the present embodiment, it is seen that the cooling tube 131 is configured with a first cooling tube 131' and a second cooling tube 131" formed at a front portion and a rear portion of the evaporator 130, respectively, to constitute two columns. For reference, the first cooling tube 131' at a front side thereof and the second cooling tube 131" at a rear side thereof are formed with the same shape, and thus the second cooling tube 131" is hidden by the first cooling tube 131' in FIG. 2.

However, the present disclosure may not be necessarily limited to this. The first cooling tube 131' at a front side thereof and the second cooling tube 131" at a rear side thereof may be formed in different shapes. On another hand, the cooling tube 131 may be formed to constitute a single column.

For the cooling tube 131, a plurality of cooling fins 132 are disposed to be separated at predetermined intervals along an extension direction of the cooling tube 131. The cooling fin 132 may be formed with a flat body made of an aluminum material, and the cooling tube 131 may be flared in a state of being inserted into an insertion hole of the cooling fin 132, and securely inserted into the insertion hole.

A plurality of support fixtures 133 may be provided at both sides of the evaporator 130, respectively, and each of which is configured to support the cooling tube 131 vertically extended and passed through along a vertical direction. An insertion groove or insertion hole to which a heat pipe 172 which will be described later can be inserted and fixed is formed on the support fixture 133.

The defrosting device 170 is provided in the evaporator 130 to remove frost generated from the evaporator 130. The defrosting device 170 may include a heating unit 171 and a heat pipe 172 (heat transfer tube).

The heating unit 171 is provided at a lower side of the evaporator 130, electrically connected to the controller (not shown), and formed to generate heat upon receiving a drive signal from the controller. For example, the controller may be configured to apply a drive signal to the heating unit 171 for each predetermined time interval or apply a drive signal to the heating unit 171 when the sensed temperature of the cooling chamber 116 is less than a predetermined temperature.

The heat pipe 172 is connected to the heating unit 171 to form a closed loop shaped passage through which working fluid (F) can circulate along with the heating unit 171. The heat pipe 172 is formed of an aluminum material.

At least part of the heat pipe 172 is disposed adjacent to the cooling tube 131 of the evaporator 130, and configured to transfer heat to the cooling tube 131 of the evaporator 130 due to high temperature working fluid (F) heated and transferred by the heating unit 171 to remove frost.

For the working fluid (F), refrigerant (for example, R-134a, R-600a, etc.) that exists in the liquid phase in a freezing condition of the refrigerator 100, but is phase-changed into the gas phase to perform the role of transferring heat when heated by the heater 171*b* may be used.

The heat pipe 172 is repeatedly bent in a zigzag shape similarly to the cooling tube 131 to constitute a plurality of columns. To this end, the heat pipe 172 may include an extension portion 172*a* and a heat emitting part 172*b*.

The extension portion 172*a* forms a passage for transferring working fluid (F) heated by the heating unit 171 in an upward direction of the evaporator 130. The extension portion 172*a* is coupled to an outlet 171*c*', 171*c*" of the heater case 171*a* provided at the lower side of the evaporator 130 and the heat emitting part 172*b* provided on the evaporator 130 (refer to FIGS. 4 and 5).

The extension portion 172*a* may include a vertical extension portion extended in an upward direction of the evaporator 130. The vertical extension portion is extended up to an upper portion of the evaporator 130 in a state of being disposed to be separated from the support fixture 133 at an outer side of the support fixture 133 provided at one side of the evaporator 130.

On the other hand, the extension portion 172*a* may further include a horizontal extension portion according to the installation position of the heating unit 171. For an example, when the heating unit 171 is provided at a position separated from the vertical extension portion (i.e., when the heating unit 171 is disposed adjacent to the right support fixture 133 on the drawing), a horizontal extension portion for coupling the heating unit 171 to the vertical extension portion may be additionally provided.

When the horizontal extension portion is coupled to the heating unit 171 and extended in an elongated manner, high temperature working fluid (F) may pass through a lower portion of the evaporator 130, thereby having an advantage of efficiently implementing defrost operations on the cooling tube 131 at a lower side of the evaporator 130.

The heat emitting part 172*b* is coupled to the extension portion 172*a* extended to an upper portion of the evaporator 130, and extended in a zigzag shape along the cooling tube 131 of the evaporator 130. The heat emitting part 172*b* is configured in combination with a plurality of horizontal tubes 172*b*1 constituting columns and a connecting tube 172*b*2 formed in a bent U-shaped tube to connect them in a zigzag shape.

The extension portion 172*a* and heat emitting part 172*b* may be extended up to a position adjacent to an accumulator 134 to remove frost formed on the accumulator 134.

As illustrated in the drawing, when the vertical extension portion is disposed at one side of the evaporator 130 at which the accumulator 134 is located, the vertical extension portion may be extended upward to a position adjacent to the accumulator 134, and then bent and extended downward toward the cooling tube 131 to be coupled to the heat emitting part 172*b*.

On the contrary, when the vertical extension portion is disposed at the other side opposite to the one side, the heat emitting part 172*b* may be coupled to the vertical extension portion and extended in a horizontal direction, and then extended upward toward the accumulator 134, and then extended downward again to correspond to the cooling tube 131.

The heat pipe 172 may be accommodated between a plurality of cooling fins 132 fixed to each column of the cooling tube 131. According to the foregoing structure, the heat pipe 172 is disposed between each column of the cooling tube 131. Here, the heat pipe 172 may be configured to make contact with the cooling fin 132.

However, the present disclosure may not be necessarily limited to this. For an example, the heat pipe 172 may be provided to pass through a plurality of cooling fins 132. In other words, the heat pipe 172 may be flared in a state of being inserted into an insertion hole of the cooling fin 132, and securely inserted into the insertion hole. According to the foregoing structure, the heat pipe 172 is disposed to correspond to the cooling tube 131.

Figure 4:
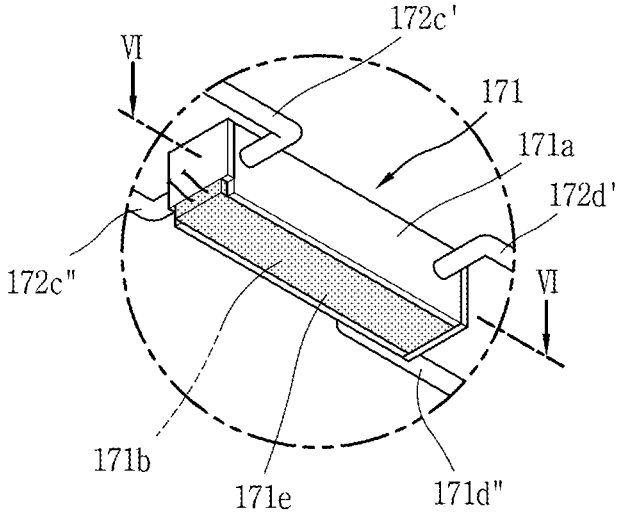
FIG. 4 is a conceptual view illustrating an example of a heating unit applied to FIG. 2.
Figure 5:
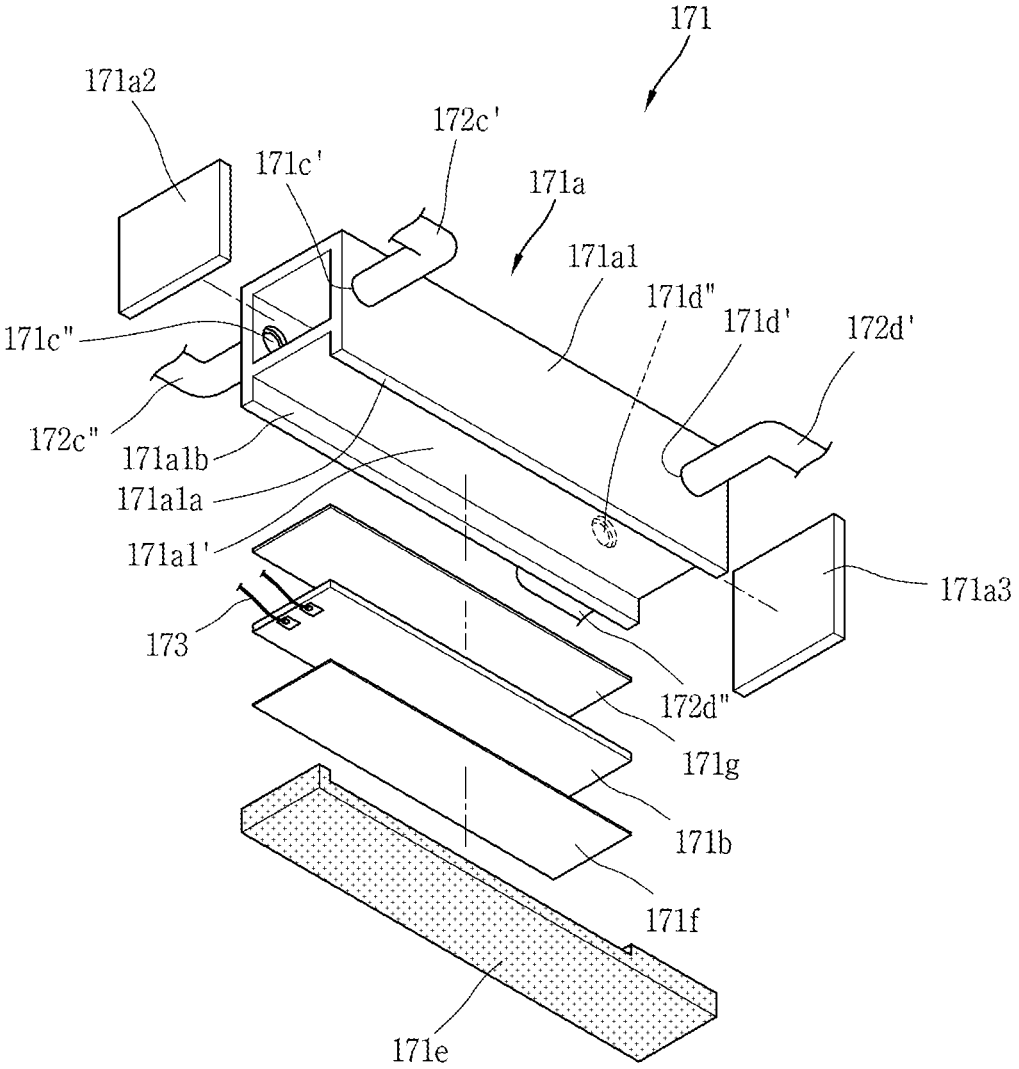
FIG. 5 is an exploded perspective view illustrating a heating unit illustrated in FIG. 4.

For the heat pipe 172, a portion coupled to the outlet 171*c*'. 171*c*" of the heater case 171*a* constitutes an entrance portion 172*c*', 172*c*" for introducing high temperature working fluid (F), and a portion coupled to the inlet 171*d*', 171*d*" of the heater case 171*a* constitutes a return portion 172*d*', 172*d*" for returning the cooled working fluid (F) (refer to FIGS. 4 and 5).

According to the present embodiment, working fluid (F) heated by the heater 171*b* forms a circulation loop in which the working fluid (F) is discharged to the entrance portion 172*c*', 172*c*" and transferred to an upper portion of the evaporator 130 through the extension portion 172*a*, and then heat is transferred to the cooling tube 131 while flowing along the heat emitting part 172*b* to perform a defrost operation, and then the working fluid (F) is returned through the return portion 172*d*', 172*d*", and reheated by the heater 171*b* again to flow the heat pipe 172 (refer to FIGS. 4 and 5).

On the other hand, the heat pipe 172 may include a first heat pipe 172' and a second heat pipe 172" disposed on a front portion and a rear portion of the evaporator 130, respectively, to form two rows. According to the present embodiment, it is illustrated that the first heat pipe 172' is disposed at a front side of the first cooling tube 131', and the second heat pipe 172" is disposed at a rear side of the second cooling tube 131" to form two rows.

The first heat pipe 172' and second heat pipe 172" are formed with different lengths. In other words, either one of the first and the second heat pipe 172', 172" is formed to be shorter than the other one. According to this, the entire path through which working fluid (F) circulates becomes shorter to increase the temperature of the first and the second heat pipe 172', 172" as a whole. As a result, it may be possible to enhance defrost performance.

The first heat pipe 172' and the second heat pipe 172" may be configured to have different total number of columns to form the first and the second heat pipe 172', 172" with different lengths.

For an example, a total number of columns of the second heat pipe 172" disposed on a rear portion of the evaporator 130 may be configured to be less than that of the first heat pipe 172'. Here, the total number of columns denotes a total number of columns formed by a plurality of horizontal tubes 172*b*1 on the heat emitting part 172*b* constituting the heat pipe 172.

According to the foregoing structure, a path through which working fluid (F) circulates may be shorter to increase the temperature of the first and the second heat pipe 172', 172" as a whole as well as the first heat pipe 172' may have a larger total number of columns than that of the second heat pipe 172", thereby transferring more heat through the first heat pipe 172'. It may be an efficient structure, considering that frost is mostly formed at a front side of the evaporator due to the flow of cool air.

According to the present drawing, it is shown that the first heat pipe 172' is configured with total eight columns, and the second heat pipe 172" is configuration with total six columns. Specifically, in a state that the highest and the lowest column of the second heat pipe 172" are disposed to correspond to the highest and the lowest column of the first heat pipe 172', respectively, a distance between two columns adjacent to each other on the second heat pipe 172" is larger than that between two columns adjacent to each other on the first heat pipe 172'.

The two adjoining columns of the second heat pipe 172 may be provided at an upper portion of the second heat pipe 172". According to the foregoing structure, a distance between two adjoining columns of the lower portion may be formed to be less than that of two adjoining columns of the upper portion. It is a design considering convection according to the temperature of working fluid (F) when the working fluid (F) circulates through the second heat pipe 172".

Specifically, working fluid (F) introduced through the entrance portion 172*c*', 172*c*" of the heat pipe 172 has the highest temperature during the circulation process of the heat pipe 172 in the gas phase at high temperatures. As illustrated in the drawing, the high-temperature working fluid (F) moves to the side of the cooling tube 131 located at an upper portion, and thus high-temperature heat is transferred to a large area by convention in the vicinity of the cooling tube 131 at the upper portion.

On the contrary, working fluid (F) flows in a state liquid and gas coexist while gradually dissipating heat, and as a result, is introduced into the return portion 172*d*', 172*d*" in the liquid phase, wherein heat at this time is a sufficient temperature for removing the frost of the cooling tube 131, but the extent of transferring heat transfer to the surrounding medium is lower as compared to the foregoing case.

Accordingly, in consideration of this, each column of the second heat pipe 172" adjacent to the return portion 172*d*', 172*d*" (i.e., a horizontal tube 172*b*1 of the heat emitting part 172*b*) is disposed at smaller intervals compared to each column of the second heat pipe 172" located at the upper portion. For example, each column of the second heat pipe 172" located at the upper portion may be disposed to correspond to the column of an adjoining cooling tube 131 by interposing one column of the cooling tube 131 therebetween, and each column of the second heat pipe 172" located at the lower portion may be disposed to correspond to each column of the cooling tube 131. According to the foregoing structure, each column (i.e., the horizontal tube 172*b*1 of the heat emitting part 172*b*) of the second heat pipe 172" is arranged at a lower portion of the evaporator 130 in a relatively larger number than that of an upper portion thereof.

According to the foregoing structure, even when it is configured that a number of columns of the second heat pipe 172" is less than that of the first heat pipe 172', defrosting on a rear portion of the evaporator 130 may be efficiently carried out by the effective layout of the second heat pipe 172".

On the other hand, the present disclosure may not be necessarily limited to this. The highest column of the second heat pipe 172" may be disposed to be lower than the highest column of the first heat pipe 172' or the lowest column of the second heat pipe 172" may be disposed to be higher than the lowest column of the first heat pipe 172'. In this case, a distance between two columns adjacent to each other on the second heat pipe 171" may be formed to correspond to (to be the same or similar to) that between two columns adjacent to each other on the first heat pipe 172'.

Hereinafter, the heating unit 171 applied to the foregoing structure will be described.

Figure 6:
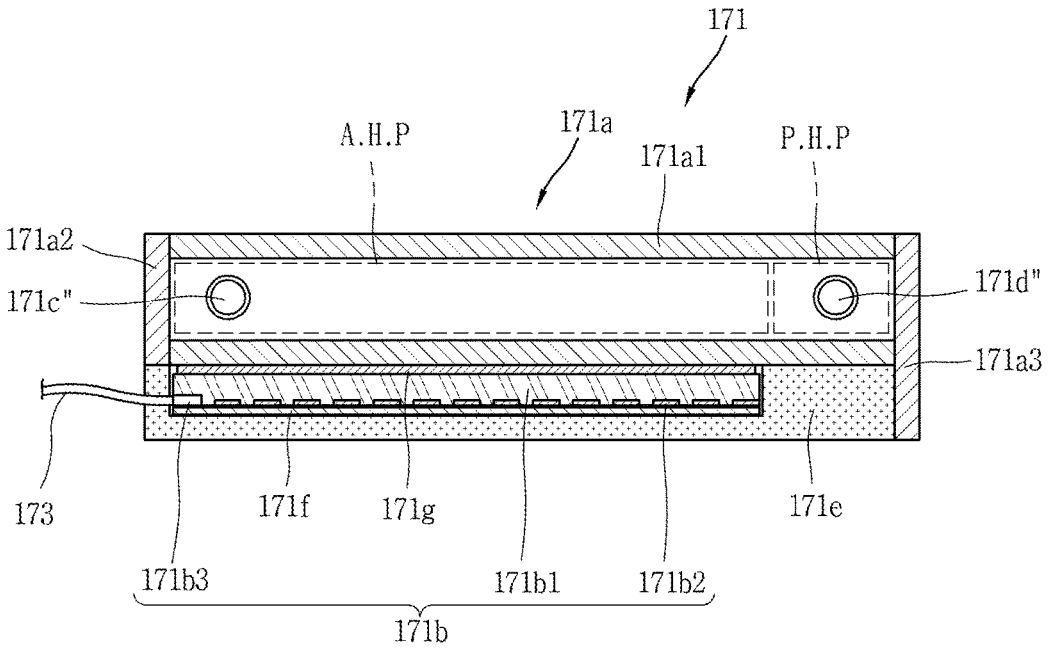
FIG. 6 is a cross-sectional view illustrating the heating unit of FIG. 4 taken along line VI-VI.
Figure 7:
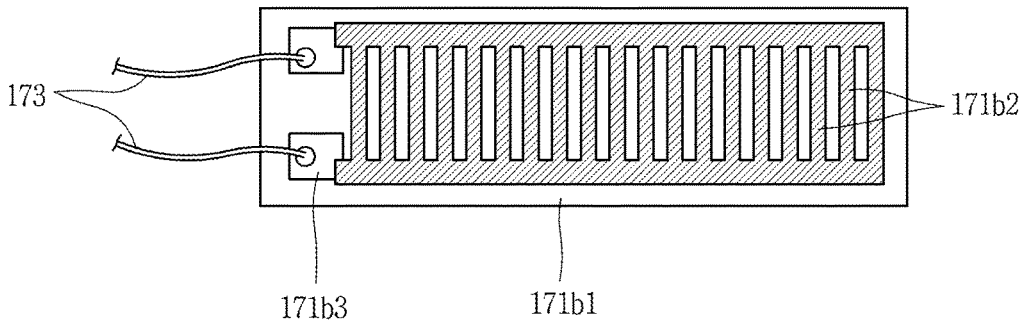
FIG. 7 is a conceptual view illustrating a heater illustrated in FIG. 5.

FIG. 4 is a conceptual view illustrating an example of the heating unit 171 applied to FIG. 2, and FIG. 5 is an exploded perspective view illustrating the heating unit 171 illustrated in FIG. 4, and FIG. 6 is a cross-sectional view illustrating the heating unit 171 of FIG. 4 taken along line VI-VI, and FIG. 7 is a conceptual view illustrating the heater 171*b* illustrated in FIG. 5.

Referring to the present drawings along with the foregoing drawings, the heating unit 171 may include a heater case 171*a* and a heater 171*b*.

The heater case 171*a* has a hollow shape therein, and is coupled to both end portions of the heat pipe 172, respectively, to form a closed loop shaped passage through which working fluid (F) can circulate along with the heat pipe 172. The heater case 171*a* may have a rectangular pillar shape, and formed of an aluminum material.

The heater case 171*a* may be disposed at one side of the evaporator 130 at which the accumulator 134 is located, the other side opposite the one side, or at any point between the one side and the other side.

The heater case 171*a* may be disposed adjacent to the lowest column of the cooling tube 131. For example, the heater case 171*a* may be disposed at the same height as the lowest column of the cooling tube 131 or disposed at a position lower than the lowest column of the cooling tube 131.

In FIGS. 2 and 3 in the above, it is shown that the heater case 171*a* is disposed in a horizontal direction of the evaporator 130 in parallel to the cooling tube 131 at a position lower than the lowest column of the cooling tube 131 at one side of the evaporator 130 at which the accumulator 134 is located. However, the present disclosure may not be necessarily limited to this. The heater case 171*a* may be vertically disposed with respect to the evaporator 130 or the outlet 171*c*', 171*c*" may be disposed to be inclined upward with respect to the inlet 171*d*', 171*d*".

The outlet 171*c*', 171*c*" and the inlet 171*d*', 171*d*" coupled to both end portions of the heat pipe 172, respectively, are formed at both sides of the heater case 171*a*, respectively, in a length direction.

Specifically, the outlet 171*c*', 171*c*" communicated with one end portion of the heat pipe 172 is formed at one side of the heater case 171*a* (for example, an outer circumferential surface adjacent to a front end portion of the heater case 171*a*). The outlet 171*c*', 171*c*" denotes an opening through which working fluid (F) heated by the heater 171*b* is discharged to the heat pipe 172.

The inlet 171*d*', 171*d*" communicated with the other end portion of the heat pipe 172 is formed at the other side of the heater case 171*a* (for example, an outer circumferential surface adjacent to a rear end portion of the heater case 171*a*). The inlet 171*d*', 171*d*" denotes an opening through which condensed working fluid (F) is collected to the heater case 171*a* while passing through the heat pipe 172.

The heater 171*b* is attached to an outer surface of the heater case 171*a*, and configured to generate heat upon receiving a drive signal from the controller. Working fluid (F) within the heater case 171*a* receives heat due to the heater 171*b* to be heated at high temperatures.

The heater 171*b* is extended and formed along one direction, and has a shape of being attached to an outer surface of the heater case 171*a* and extended along a length direction of the heater case 171*a*. A plate-shaped heater (for example, a plate-shaped ceramic heater) having a plate shape is used for the heater 171*b*.

According the present embodiment, the heater case 171*a* is formed in a rectangular pipe shape in which a vacant space therein has a rectangular cross-sectional shape, and it is shown that a plate-shaped heater 171*b* is attached to a bottom surface of the heater case 171*a*. In this manner, the structure in which the heater 171*b* is attached to a bottom surface of the heater case 171*a* may be beneficial in generating a driving force in an upward direction on the heated working fluid (F), and defrost water generated due to the defrost operation may not directly fall onto the heater 171*b*, thereby preventing a short circuit.

A heating element 171*b*2 (refer to FIGS. 6 and 7) is formed on the heater 171*b*, and configured to generate heat while supplying power. As illustrated in FIG. 6, the heater case 171*a* is partitioned into an active heating part (AHP) corresponding to a portion on which the heating element 171*b*2 is disposed and a passive heating part (PHP) corresponding to a portion on which the heating element 171*b*2 is not disposed. The active heating part (AHP) and passive heating part (PHP) will be described later.

The heat pipe 172 and heater case 171*a* may be formed of the same type material (for example, aluminum material), and in this case, the heat pipe 172 may be coupled to the outlet 171*c*', 171*c*" and the inlet 171*d*', 171*d*" of the heater case 171*a*.

For reference, when the heater 171*b* is configured with a cartridge type and mounted within the heater case 171*a*, the heater case 171*a* with a copper material other than an aluminum material will be used to bond and seal between the heater 171*b* and the heater case 171*a*.

In this manner, when the heat pipe 172 and the heater case 171*a* are formed of different types of materials (as described above, when the heat pipe 172 is formed of an aluminum material, and the heater case 171*a* is formed of a copper material), it is difficult to directly connect the heat pipe 172 to the outlet 171*c*', 171*c*" and the inlet 171*d*', 171*d*" of the heater case 171*a*. Accordingly, for the connection between them, an outlet tube is extended and formed to the outlet 171*c*', 171*c*" of the heater case 171*a*, and a return tube is extended and formed to the inlet 171*d*', 171*d*" to connect the heat pipe 172 to the outlet tube and the return tube, and thus the bonding and sealing process is required for the procedure.

However, according to a structure in which the heater 171*b* is attached to an outer surface of the heater case 171*a*, the heater case 171*a* may be formed of the same material as that of the heat pipe 172, and the heat pipe 172 may be directly coupled to the outlet 171*c*', 171*c*" and the inlet 171*d*', 171*d*" of the heater case 171*a*.

On the other hand, as working fluid (F) filled into the heater case 171*a* is heated to high temperatures by the heater 171*b*, the working fluid (F) flows due to a pressure difference to move the heat pipe 172. Specifically, the working fluid (F) at high temperatures heated by the heater 171*b* and discharged to the outlet 171*c*', 171*c*" transfers heat to the cooling tube 131 of the evaporator 130 while moving through the heat pipe 172. The working fluid (F) is gradually cooled while passing through the heat exchange process and introduced into the inlet 171*d*', 171*d*". The cooled working fluid (F) is reheated by the heater 171*b* and then discharged to the outlet 171*c*', 171*c*" again to repeatedly perform the foregoing processes. The defrosting of the cooling tube 131 is carried out due to such a circulation method.

According to a structure in which the heat pipe 172 is configured with the first and the second heat pipe 172', 172", the first and the second heat pipe 172', 172" are coupled to the inlet 171*d*', 171*d*" and the outlet 171*c*', 171*c*" of the heating unit 171, respectively.

Specifically, the outlet 171*c*', 171*c*" of the heating unit 171 is configured with a first outlet 171*c*' and a second outlet 171*c*", and one end portion of the first and the second heat pipe 172', 172", respectively, is coupled to the first and the second outlet 171*c*', 171*c*", respectively. Due to the foregoing connection structure, working fluid (F) in the gas phase heated by the heating unit 171 is discharged to the first and the second heat pipe 172', 172", respectively, through the first and the second outlet 171*c*', 171*c*".

The first and the second outlet 171*c*', 171*c*" may be formed at both sides of an outer circumference of the heater case 171*a*, respectively, and formed in parallel at a front portion of the heater case 171*a*.

It may be understood that one end portion of the first and the second heat pipe 172', 172" coupled to the first and the second outlet 171*c*', 171*c*", respectively, is the first and the second entrance portions 172*c*', 172*c*" (a portion to which working fluid (F) at high temperatures heated by the heater 171*b* is introduced) due to the function.

Furthermore, the inlet 171*d*', 171*d*" of the heating unit 171 is configured with a first inlet 171*d*' and a second inlet 171*d*", and the other end of the first and the second heat pipe 172', 172", respectively, is coupled to the inlet 171*d*', 171*d*", respectively. Due to the connection structure, working fluid (F) in the liquid phase cooled while moving the heat pipes 172, respectively, is introduced into the heater case 171*a* through the inlet 171*d*', 171*d*".

The inlet 171*d*', 171*d*" may be formed at both sides of an outer circumference of the heater case 171*a*, respectively, and formed in parallel at a rear portion of the heater case 171*a*.

It may be understood that the other end portion of the first and the second heat pipe 172', 172" coupled to the inlet 171*d*', 171*d*", respectively, is the first and the second return portions 172*d*', 172*d*" (a portion to which working fluid (F) in the liquid phase cooled while moving through the heat pipes 172, respectively, is collected) due to the function.

On the other hand, referring to FIGS. 5 and 6, the outlet 171*c*', 171*c*" of the heater case 171*a* may be formed at a position separated by a predetermined distance from a front end of the heater case 171*a* in a backward direction. In other words, it may be understood that the front end portion of the heater case 171*a* is protruded and formed in a forward direction from the outlet 171*c*', 171*c*".

The heating element 171*b*2 of the heater 171*b* may be extended and formed from one point between the inlet 171*d*', 171*d*" and the outlet 171*c*', 171*c*" to a position passed through the outlet 171*c*', 171*c*". According to this, the outlet 171*c*', 171*c*" of the heater case 171*a* is located within the active heating part (AHP).

Due to the foregoing structure, part of working fluid (F) stays at a front end portion (a space between an inner front end and the outlet 171*c*', 171*c*" of the heater case 171*a*) to prevent the overheating of the heater 171*b*.

Specifically, working fluid (F) heated by the active heating part (AHP) moves in a direction through which the working fluid (F) circulates, namely, toward a front end portion of the heater case 171*a*, and during this process, part of the working fluid (F) is discharged to the branched outlet 171*c*', 171*c*", but the remaining working fluid passes through the outlet 171*c*', 171*c*" and stays while forming a vortex at a front end portion of the heater case 171*a*.

In this manner, the whole of the heated working fluid (F) is not immediately discharged to the outlet 171*c*', 171*c*", but part thereof stays within the heater case 171*a* without being immediately discharged to the outlet 171*c*', 171*c*", thereby further preventing the overheating of the heater 171*b*.

As described above, the heater 171*b* applied to the heating unit 171 of the present disclosure may be formed in a plate shape, and a plate-shaped ceramic heater 171*b* may be typically used.

As illustrated in FIG. 7, the heater 171*b* may include a base plate 171*b*1, a heating element 171*b*2 and a terminal 171*b*3.

The base plate 171*b*1 is formed of a ceramic material, and formed in a plate shape extended in an elongated manner along one direction. The base plate 171*b*1 is attached to an outer surface of the heater case 171*a*, and disposed along a length direction of the heater case 171*a*.

The heating element 171*b*2 is formed on the base plate 171*b*1, and the heating element 171*b*2 is configured to emit heat during the application of power. In a state that the base plate 171*b*1 is attached to an outer surface of the heater case 171*a*, the heating element 171*b*2 has a shape of being extended from one point between the inlet 171*d*', 171*d*" and the outlet 171*c*', 171*c*" toward the outlet 171*c*', 171*c*".

The heating element 171*b*2 may be formed by patterning a resistor *for example, powder mixed with ruthenium and platinum, tungsten, etc.) on the base plate 171*b*1 with a specific pattern. The heating element 171*b*2 may be extended and formed along a length direction of the base plate 171*b*1.

A terminal 171*b*3 configured to electrically connect the heating element 171*b*2 to power is provided at one side of the base plate 171*b*1, and a lead wire 173 electrically coupled to the power is provided to the terminal 171*b*3.

On the other hand, the heater case 171*a* is partitioned into an active heating part (AHP) corresponding to a portion on which the heating element 171*b*2 is disposed and a passive heating part (PHP) corresponding to a portion on which the heating element 171*b*2 is not disposed.

The active heating part (AHP) is a portion directly heated by the heating element 171*b*2, and working fluid (F) at the liquid phase is heated by the active heating part (AHP) and phase-changed into the gas phase at high temperatures.

The outlet 171*c*', 171*c*" of the heater case 171*a* may be located within the active heating part (AHP) or located at a front side than the active heating part (AHP). In FIG. 6, it is illustrated that a portion formed with the heating element 171*b*2 of the heater 171*b* is extended and formed in a forward direction through a lower portion of the outlet 171*c*', 171*c*" formed on an outer circumference of the heater case 171*a*. In other words, according to the present embodiment, the outlet 171*c*', 171*c*" of the heater case 171*a* is located within the active heating part (AHP).

The passive heating part (PHP) is formed at a rear side of the active heating part (AHP). The passive heating part (PHP) indirectly receives heat to be heated to a predetermined temperature level though it is not a portion directly heated by the heating element 171*b*2 like the active heating part (AHP). Here, the passive heating part causes a predetermined temperature increase to the working fluid (F) in the liquid phase, but does not have high temperatures to the extent of phase-changing the working fluid (F) to the gas phase. In other words, in the aspect of temperature, the active heating part (AHP) forms a relatively high-temperature portion and the passive heating part forms a relatively low-temperature portion.

If working fluid (F) is configured to directly return to a side of the active heating part (AHP) at high temperatures, then it may occur a case where the collected working fluid (F) is reheated and flowed backward without being efficiently returned into the heater case 171*a*. It may be an obstacle to the circulation flow of the working fluid (F) within the heat pipe 172, thereby causing a problem of overheating the heater 171*b*.

In order to solve the foregoing problem, it is configured such that the inlet 171*d*', 171*d*" of the heating unit 171 is formed to correspond to the passive heating part (PHP) not to allow working fluid (F) that has moved through the heat pipe 172 and then returned to be immediately introduced into the active heating part (AHP).

According to the present embodiment, it is configured that the inlet 171*d*', 171*d*" of the heating unit 171 is located within the passive heating part (PHP) to allow working fluid (F) that has moved through the heat pipe 172 and then returned to be introduced into the passive heating part (PHP). In other words, the inlet 171*d*', 171*d*" of the heating unit 171 is formed at a portion on which the heating element 171*b*2 is not disposed on the heater case 171*a*.

As described above, the passive heating part (PHP) is associated with the formation location of the heating element 171*b*2. Accordingly, if the heating element 171*b*2 is not extended and formed up to the inlet 171*d*', 171*d*" of the heating unit 171, then the base plate 171*b*1 of the heater 171*b* may be extended and formed up to a portion corresponding to the inlet 171*d*', 171*d*". In other words, the base plate 171*b*1 may be disposed to cover the most bottom surface of the heater case 171*a*, and the heating element 171*b*2 may be formed at a position out of the inlet 171*d*', 171*d*", thereby preventing working fluid (F) returned through the inlet 171*d*', 171*d*" from flowing backward.

Hereinafter, the detailed structure of the heater case 171*a* and the coupling structure between the heater case 171*a* and the heater 171*b* will be described in more detail.

The heater case 171*a* may include a main case 171*a*1, a first cover 171*a*2 and a second cover 171*a*3 coupled to both sides of the main case 171*a*1, respectively.

The main case 171*a*1 is provided with a vacant space therein, and has a shape in which both end portions thereof are open. The main case 171*a*1 may be formed of an aluminum material. In FIG. 5, it is illustrated the main case 171*a*1 in a rectangular pillar shape in which a vacant space therein having a rectangular cross-sectional shape is extended and formed in an elongated manner along one direction.

The first and the second cover 171*a*2, 171*a*3 are mounted at both sides of the main case 171*a*1 to cover both end portions of the main case 171*a*1 that are open. The first and the second cover 171*a*2, 171*a*3 may be formed of an aluminum material like the main case 171*a*1.

According to the present embodiment, it is shown a structure in which the outlet 171*c*', 171*c*" and the inlet 171*d*', 171*d*" are provided at positions separated from each other along a length direction of the main case 171*a*1, respectively, and the both end portions (the entrance portion 172*c*', 172*c*" coupled to the outlet 171*c*', 171*c*" and the return portion 172*d*', 172*d*" coupled to the inlet 171*d*', 171*d*") of the heat pipe 172 are coupled to the outlet 171*c*', 171*c*" and the inlet 171*d*', 171*d*".

More specifically, the first outlet 171*c*' and the first inlet 171*d*' are formed at positions separated from each other along a length direction on one lateral surface of the main case 171*a*1, and the second outlet 171*c*" and the second inlet 171*d*" are formed at positions separated from each other along a length direction on the other lateral surface facing the one surface. Here, the first outlet 171*c*' and the second outlet 171*c*" may be disposed to face each other, and the first inlet 171*d*' and the second inlet 171*d*" may be disposed to face each other.

However, the present disclosure may not be necessarily limited to this. At least one of the inlet 171*d*', 171*d*" and the outlet 171*c*', 171*c*" may be formed on a first and/or a second cover 171*a*2, 171*a*3.

On the other hand, the heating unit 171 is provided at the lower side of the evaporator 130, and thus defrost water generated due to defrosting in the aspect of the structure may flow down to the heating unit 171. The heater 171*b* provided in the heating unit 171 is an electronic component, and thus when defrost water is brought into contact with the heater 171*b*, it may cause a short circuit. As described above, the heating unit 171 of the present disclosure may include the following sealing structure to prevent moisture including defrost water from infiltrating into the heater 171*b*.

First, the heater 171*b* is attached to a bottom surface of the main case 171*a*1, and a first and a second extension fin 171*a*1*a*, 171*a*1*b* extended and formed in a downward direction from the bottom surface to cover a lateral surface of the heater 171*b* attached to the bottom surface are configured at both sides of the main case 171*a*1. Due to the structure, even when defrost water generated due to defrosting falls onto the main case 171*a*1 and flows down along an outer surface of the main case 171*a*1, the defrost water does not infiltrate into the heater 171*b* accommodated at an inner side of the first and the second extension fin 171*a*1*a*, 171*a*1*b*.

Furthermore, a sealing member 171*e* may be filled into a recessed space 171*a*1' formed by a rear surface of the heater 171*b* and the first and the second extension fin 171*a*1*a*, 171*a*1*b* as described above. Silicon, urethane, epoxy or the like may be used for the sealing member 171*e*. For example, epoxy in the liquid phase may be filled into the recessed space 171*a*1' and then subject to the curing process to complete the sealing structure of the heater 171*b*. Here, the first and the second extension fin 171*a*1*a*, 171*a*1*b* may function as a sidewall limiting the recessed space 171*a*1' into which the sealing member 171*e* is filled.

An insulating material 171*f* may be interposed between a rear surface of the heater 171*b* and the sealing member 171*e*. A mica sheet with a mica material ma be used for the insulating material 171*f*. The insulating material 171*f* may be disposed on a rear surface of the heater 171*b*, thereby limiting heat from being transferred to a side of the rear surface of the heater 171*b* when the heating element 171*b*2 emits heat according to the application of power.

Moreover, a thermally conductive adhesive 171*g* may be interposed between the main case 171*a*1 and the heater 171*b*. The thermally conductive adhesive 171*g* may attach the heater 171*b* to the main case 171*a*1 to perform the role of transferring heat generated from the heater 171*b* to the main case 171*a*1. A heat-resistant silicone capable of enduring high temperatures may be used for the thermally conductive adhesive 171*g*.

On the other hand, at least one of the first and the second cover 171*a*2, 171*a*3 may be extended and formed from the bottom of the main case 171*a*1 in a downward direction to surround the heater 171*b* along with the first and the second extension fin 171*a*1*a*, 171*a*1*b*. Due to the structure, the filling of the sealing member 171*e* may be more easily carried out.

However, considering a structure in which the lead wire 173 coupled to the terminal 171*b*3 of the heater 171*b* is extended from one side of the heater case 171*a* to an outside, a cover corresponding to one side of the heater case 171*a* on the first and the second cover 171*a*2, 171*a*3 may not be extended and formed in a downward direction or may be provided with a groove or hole allowing the lead wire 173 to pass therethrough even when extended and formed in a downward direction.

According to the present embodiment, it is shown that the second cover 171*a*3 is extended and formed from the bottom surface of the main case 171*a*1 in a downward direction, and the lead wire 173 is extended and formed to a side of the first cover 171*a*2.

Figure 8:
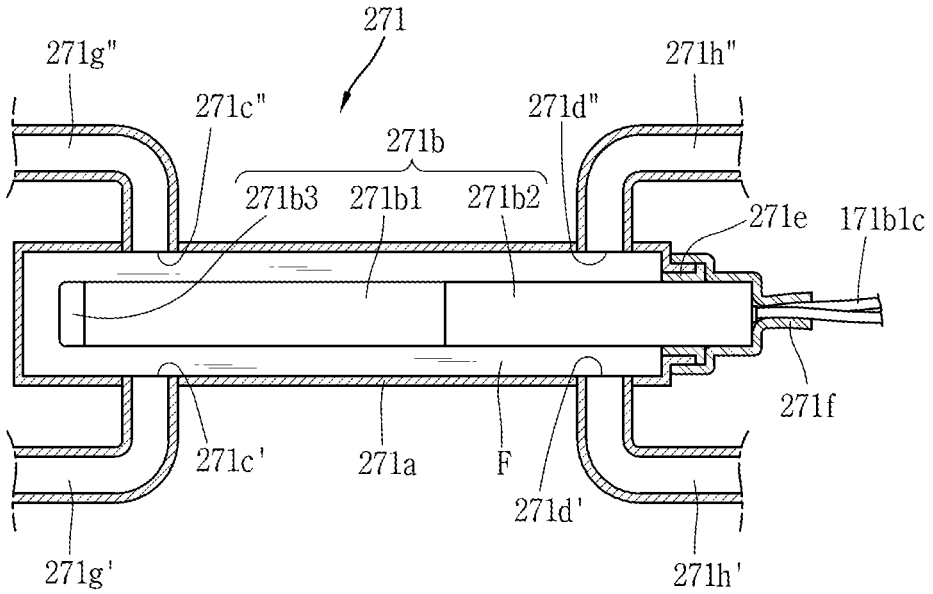
FIGS. 8 and 9 are a transverse cross-sectional view and a longitudinal cross-sectional view illustrating another example of a heating unit applied to FIG. 2.
Figure 9:
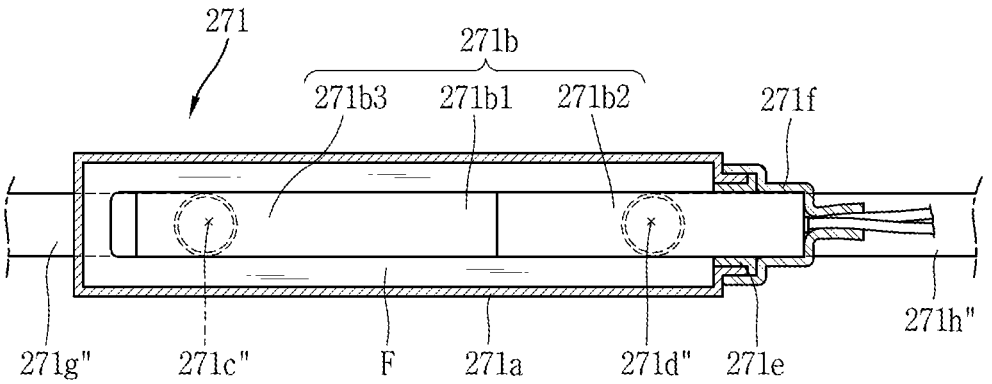

FIGS. 8 and 9 are a transverse cross-sectional view and a longitudinal cross-sectional view illustrating another example of the heating unit 271 applied to FIG. 2.

Considering a heating unit 271 in detail with reference to the accompanying drawings, the heating unit 271 may include a heater case 271*a* and a heater 271*b*.

According to the present embodiment, the heater case 271*a* is extended and formed along one direction and disposed in an elongated manner along a horizontal direction at a lower portion of the evaporator 130. The heater case 271*a* may be formed in a cylindrical or rectangular pillar shape, and formed of a copper material or aluminum material.

The heater case 271*a* may be disposed adjacent to the lowest column of the cooling tube 131. For example, the heater case 271*a* may be disposed at the same height as the lowest column of the cooling tube 131 or disposed at a position lower than the lowest column of the cooling tube 131.

The heater case 271*a* has a hollow shape therein, and is coupled to both end portions of the heat pipe 172, respectively, to form a closed loop shaped passage through which working fluid (F) can circulate along with the heat pipe 172. The first and the second outlet 271*c*', 271*c*" and the first and the second inlet 271*d*', 271*d*" coupled to both end portions of the first and the second heat pipe 172', 172", respectively, are formed at both sides of the heater case 171*a*, respectively, in a horizontal direction.

Specifically, the first and the second outlet 271*c*', 271*c*" communicated with one end portion of the first and the second heat pipe 172', 172", respectively, is formed at one side of the heater case 271*a* (for example, an outer circumferential surface adjacent to a front end portion of the heater case 271*a*). The first and the second inlet 271*d*', 271*d*" denote an opening through which working fluid (F) heated by the heater 271*b* is discharged to the first and the second heat pipe 172', 172".

The first and the second inlet 271*d*', 271*d*" communicated with the other end portion of the first and the second heat pipe 172', 172", respectively, is formed at the other side of the heater case 271*a* (for example, an outer circumferential surface adjacent to a rear end portion of the heater case 271*a*). The first and the second inlet 271*d*', 271*d*" denote an opening through which condensed working fluid (F) is collected to the heater case 271*a* while passing through the first and the second heat pipe 172', 172".

The heater 271*b* has a shape in which part thereof is accommodated into the heater case 271*a* and extended along a length direction of the heater case 271*a*. According to the present conceptual view, it is shown that the heater 271*b* is arranged in parallel along a horizontal direction of the evaporator 130.

The heater 271*b* may be inserted through the other side of the heater case 271*a* and fixed and sealed to the heater case 271*a*. Here, it is configured such that part of the heater 271*b* is accommodated into the heater case 271*a*, and another part of the heater 271*b* is exposed to an outside of the heater case 271*a*.

The heater 271*b* accommodated into the heater case 271*a* is disposed to be separated from an inner circumferential surface of the heater case 271*a* by a preset distance. According to the layout, an annular space having an annular gap is formed between an inner circumferential surface of the heater case 271*a* and an outer circumferential surface of the heater 271*b*.

A heating coil 271*b*1*b* (refer to FIG. 10) is partially formed within the heater 271*b* accommodated into the heater case 271*a*, and configured to generate heat while supplying power. A portion around which the heating coil 271*b*1*b* is wound within the heater 271*b* constitutes an active heating part 271*b*1 heated to high temperatures to evaporate working fluid. The active heating part 271*b*1 will be described later.

The first and the second heat pipe 172', 172" are coupled to the first and the second outlet 271*c*', 271*c*" provided at the left side of the heater case 271*a* on the drawing and the first and the second inlet 271*d*', 271*d*" provided at the right side thereof, respectively, and a predetermined amount of working fluid (F) is filled therein.

The first and the second heat pipe 172', 172" may be coupled to the first and the second outlet 271*c*', 271*c*" and the first and the second inlet 271*d*', 271*d*" of the heater case 271*a*, but when they are formed of different types of materials (as described above, when the first and the second heat pipe 172', 172" are formed of an aluminum material, and the heater case 271*a* is formed of a copper material), it may be difficult to perform a connection operation.

In this case, an outlet tube 271*g*', 271*g*" may be extended and formed on the first and the second outlet 271*c*', 271*c*", and a return tube 271*h*', 271*h*" may be extended and formed on the first and the second inlet 271*d*', 271*d*" to connect between the heater case 271*a* and the first and the second heat pipe 172', 172". The outlet tube 271*g* and the return tube 271*h* may be formed of the same material as that of the heater case 271*a*, and integrally coupled to each other. In this manner, it may be understood that the outlet tube 271*g* and the return tube 271*h* are an additional configuration between them for an easy connection to the first and the second heat pipe 172', 172".

As working fluid (F) filled therein by the heating unit 271 is heated to high temperatures, the working fluid (F) flows due to a pressure difference to move the first and the second heat pipe 172', 172". Specifically, the working fluid (F) at high temperatures heated by the heater 271*b* and discharged to the first and the second outlet 271*c*', 271*c*" transfers heat to the cooling tube 131 of the evaporator 130 while moving through the first and the second heat pipe 172', 172". The working fluid (F) is gradually cooled while passing through the heat exchange process and introduced into the first and the second inlet 271*d*', 271*d*". The cooled working fluid (F) is reheated by the heater 271*b* and then discharged to the outlet first and the second outlet 271*c*', 271*c*" again to repeatedly perform the foregoing processes. The defrosting of the cooling tube 131 is carried out due to such a circulation method.

On the other hand, a defrosting device 270 may be configured as follows to prevent the overheating of the heater 271*b*.

First, as described above, the heater 271*b* has a shape in which at least part thereof is accommodated into the heater case 271*a* and extended along a length direction of the heater case 271*a*. Furthermore, a predetermined amount of working fluid (F) is filled into the heating unit 271 and heat pipe 272.

When the heater 271*b* is operated in case where an upper end portion of the heater 271*b* is exposed above the water level of the working fluid (F) when the whole of working fluid (F) is placed in the liquid phase (when the heater 271*b* is not operated), the temperature of the upper end portion of the heater 271*b* abruptly increases, contrary to the remaining portion thereof immersed in the working fluid (F).

When such a state continues, the upper end portion of the heater 271*b* is overheated to cause a critical damage (for example, fire) on the defrosting device 270, and generate a phenomenon in which heated working fluid (F) flows backward to the other end portion of the heat pipe 272 through which the returned working fluid (F) flows.

In order to prevent such a phenomenon, working fluid (F) filled into the heater case 271*a* is filled in the liquid phase to form a water level at a position higher than that of the upper end portion of the heater 271*b*. In other words, it is configured such that the heater 271*b* is immersed below the water level of the working fluid (F).

According to the foregoing configuration, since the heater 271*b* is heated in a state of being immersed below the water level of the working fluid (F) in the liquid phase, the working fluid (F) evaporated by heating may be sequentially transferred to one end portion of the heat pipe 272, thereby allowing efficient circulation flow as well as preventing the overheating of the heating unit 271.

On the other hand, referring to FIGS. 8 and 9, the outlet 271*c*', 271*c*" of the heater case 271*a* may be formed at a position separated by a predetermined distance from a front end of the heater case 271*a* in a backward direction. In other words, it may be understood that the front end portion of the heater case 271*a* is protruded and formed in a forward direction from the outlet 271*c*', 271*c*".

On the other hand, the heater 271*b* is divided into an active heating part 271*b*1 and a passive heating part according to whether or not the heater 271*b* emits heat in an active manner, and the passive heating part may include a first passive heating part 271*b*2 at a rear side of the active heating part 271*b*1 and a second passive heating part 271*b*3 at a front side of the active heating part 271*b*1.

Specifically, the active heating part 271*b*1 is configured to generate heat in an active manner. The working fluid (F) in the liquid phase may be heated by the active heating part 271*b*1 and phase-changed into the gas phase at high temperatures.

The first and the second outlet 271*c*', 271*c*" of the heater case 271*a* may be located to correspond to the active heating part 271*b*1 or located at a front side than the active heating part 271*b*1. In FIGS. 8 and 9, it is illustrated that the active heating part 271*b*1 is extended and formed in a forward direction through the first and the second outlet 271*c*', 271*c*" formed on an outer circumference of the heater case 271*a*. Here, a front end of the heater 271*b* is preferably located to be separated from an inner front end of the heater case 271*a* in a backward direction.

Due to the foregoing structure, part of working fluid (F) stays at a front end portion (a space between an inner front end and the outlet 271*c*', 271*c*" of the heater case 271*a*) to prevent the overheating of the heater 271*b*.

Specifically, working fluid (F) heated by the active heating part 271*b*1 moves in a direction through which the working fluid (F) circulates, namely, toward a front end portion of the heater case 271*a*, and during this process, part of the working fluid (F) is discharged to the branched outlet 271*c*', 271*c*", but the remaining working fluid passes through the outlet 271*c*', 271*c*" and stays while forming a vortex at a front end portion of the heater case 271*a*.

The whole of the heated working fluid (F) is not immediately discharged to the outlet 271*c*', 271*c*", but part thereof stays within the heater case 271*a* to be brought into contact with the active heating part 271*b*1 without being immediately discharged to the outlet 271*c*', 271*c*", thereby further preventing the overheating of the active heating part 271*b*1.

The first passive heating part 271*b*2 is extended and formed in a backward direction at a rear end of the active heating part 271*b*1. The first passive heating part 271*b*2 receives heat by the active heating part 271*b*1 to be heated to a predetermined temperature level though it does not generate heat by itself like the active heating part 271*b*1. Here, the first passive heating part 271*b*2 causes a predetermined temperature increase to the working fluid (F) in the liquid phase, but does not have high temperatures to the extent of phase-changing the working fluid (F) to the gas phase.

Considering the heater 271*b* in the aspect of temperature, the active heating part 271*b*1 forms a relatively high-temperature portion and the first passive heating part 271*b*2 forms a relatively low-temperature portion.

Structurally, a heating coil 271*b*1*b* (refer to FIG. 10) within the heater 271*b* is wound a certain number of turns and configured to generate heat at high temperatures while supplying power. In this manner, a portion in which the heating coil 271*b*1*b* is wound a certain number of turns constitutes the active heating part 271*b*1. An insulating material 271*b*2*a* (refer to FIG. 6) is filled into a portion through which the lead wire 271*b*1*c* at a rear side of the active heating part 271*b*1 passes to constitute the first passive heating part 271*b*2. Magnesium oxide may be used for the insulating material 271*b*2*a*.

If working fluid (F) is configured to directly return to a side of the active heating part 271*b*1 at high temperatures provided within the heating unit 271, then it may occur a case where the collected working fluid (F) is reheated and flowed backward without being efficiently returned into the heating unit 271. It may be an obstacle to the circulation flow of the working fluid (F) within the heat pipe 272, thereby causing a problem of overheating the heating unit 271.

In order to solve the foregoing problem, it is configured such that the inlet 271*d*', 271*d*" of the heating unit 271 is formed at a position out of the active heating part 271*b*1 not to allow working fluid (F) that has moved through the heat pipe 272 and then returned to be immediately introduced into the active heating part 271*b*1.

In association with this, according to the present embodiment, it is configured that the inlet 271*d*', 271*d*" of the heating unit 271 is located to correspond to the first passive heating part 271*b*2 to allow working fluid (F) that has moved through the heat pipe 272 and then returned to be introduced into a space between the heater case 271*a* and the first passive heating part 271*b*2. In other words, the inlet 271*d*', 271*d*" of the heating unit 271 is formed on an outer circumference of a portion surrounding the first passive heating part 271*b*2 on the heater case 171*a*.

Here, it is configured such that part of the first passive heating part 271*b*2 is exposed to an outside in a backward direction from a rear end portion of the heater case 271*a*. The first passive heating part 271*b*2 exposed to an outside of the heater case 271*a* is configured to emit the heat of the heater 271*b* to an outside to reduce a surface load density of the heater 271*b*. When the surface load density of the heater 271*b* is reduced, the overheating of the heater 271*b* may be prevented to secure reliability as well as extend the lifespan of the heater 271*b*.

Hereinafter, the external heat emission structure of the first passive heating part 271*b*2 and the sealing structure of the first passive heating part 271*b*2 exposed to an outside will be described in detail based on the detailed configuration of the heater 271*b*.

Figure 10:
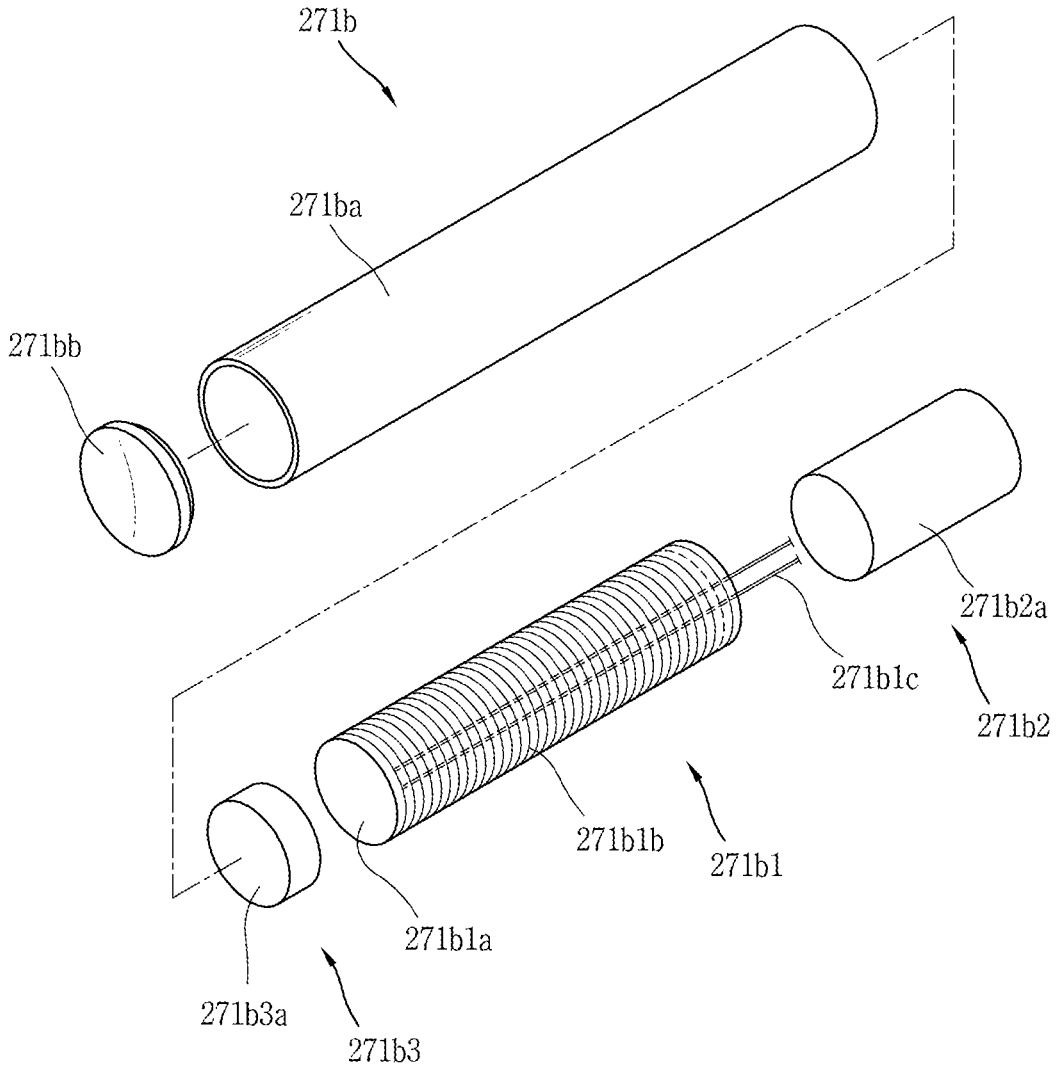
FIG. 10 is an exploded perspective view illustrating a heater illustrated in FIG. 8.

FIG. 10 is an exploded perspective view illustrating the heater illustrated in FIG. 8.

Referring to FIG. 10 along with the foregoing FIGS. 8 and 9, the heater 271*b* may include a heater frame 271*ba* forming an appearance and provided with a vacant space therein. It is configured that heater frame 271*ba* is disposed along a length direction within the heater case 271*a*, and part thereof is exposed to an outside of the heater case 271*a*. The heater frame 271*ba* may be formed of a stainless steel material.

The heater 271*b* is divided into an active heating part 271*b*1 and a passive heating part according to whether or not the heater 271*b* emits heat in an active manner, and the passive heating part may include a first passive heating part 271*b*2 at a rear side of the active heating part 271*b*1 and a second passive heating part 271*b*3 at a front side of the active heating part 271*b*1.

The active heating part 271*b*1 may include a bobbin 271*b*1*a* in a pillar shape inserted into the heater frame 271*ba* in a length direction, and a heating coil 271*b*1*b* wound on an outer circumference of the bobbin 271*b*1*a* and extended along the length direction of the bobbin 271*b*1*a*. The bobbin 271*b*1*a* may be formed of an insulating material, for example, magnesium oxide. It is configured that the heating coil 271*b*1*b* is heated to high temperatures when power is supplied through the lead wire 271*b*1*c* which will be described later. A nichrome wire may be used for the heating coil 271*b*1*b*.

The first and the second passive heating part 271*b*2, 271*b*3 may include insulating materials 271*b*2*a*, 272*b*3*a* filled into an inner vacant space at a rear side and a front side of the heater frame 271*ba* into which the bobbin 271*b*1*a* is inserted, respectively. For an example, magnesium oxide powder which is an insulating material 271*b*2*a* may be sealed into an inner vacant space at a rear side of the heater frame 271*ba* into which the bobbin 271*b*1*a* is inserted and then internal air may be discharged to form a solidified first passive heating part 271*b*2.

The insulating materials 271*b*2*a*, 272*b*3*a* may be filled into a vacant space between an outer circumference of the bobbin 271*b*1*a* and an inner circumference of the heater frame 271*ba*. In other words, a drawing in which the insulating materials 271*b*2*a*, 272*b*3*a* are provided at a front side and a rear side of the bobbin 271*b*1*a*, respectively, is only a conceptual division for the sake of convenience of explanation, and it does not mean that they are completed divided.

The lead wire 271*b*1*c* is configured to connect the power to the heating coil 271*b*1*b* through the insulating material 271*b*2*a* forming the first passive heating part 271*b*2. The lead wire 271*b*1*c* may be configured to pass through the bobbin 271*b*1*a*.

A cover member 271*bb* may be coupled to a front opening portion of the heater frame 271*ba* to cover the insulating material 272*b*3*a* forming the second passive heating part 271*b*3. The cover member 271*bb* may be coupled to the heater frame 271*ba* by welding, and have an inwardly concave shape to endure a pressure occurring within the heater 271*b*. According to the foregoing structure, a front end of the second passive heating part 271*b*3 constitutes a front end of the heater 271*b*.

On the other hand, the heater frame 271*ba* may be fixed to the heater case 271*a* through a fastening member 271*e*. The fastening member 271*e* is formed to surround an outer circumference of the heater frame 271*ba*, and fastened to the heater case 271*a*. A space between the heater frame 271*ba* and the fastening member 271*e* and between the fastening member 271*e* and the heater case 271*a* may be sealed to prevent the introduction of air or moisture. To this end, the fastening member 271*e* may be configured to include an elastic material so as to be closely coupled to the heater frame 271*ba* and heater case 271*a* or sealed by a heat-resistant silicone, welding or the like.

A rear end portion of the heater case 271*a* and the heater frame 271*ba* exposed to an outside may be wrapped and sealed by heat shrink tube 271*f*. The heat shrink tube 271*f* is shrunk during heating to be closed adhered to the components accommodated therein, thereby closely sealing a gap between the heater case 271*a* and the heater frame 271*ba*. The heat shrink tube 271*f* may be configured to wrap and seal even part of the lead wire 271*b*1*c* extended from the heater frame 271*ba* to an outside.

The first and the second inlet 271*d*', 271*d*" of the heater case 271*a* may be formed at a position separated from a rear end of the heater case 271*a* by a predetermined distance in an inward direction to form the fixing and sealing structure of the foregoing heater 271*b* at a rear end portion of the heater case 271*a*.

Figure 11:
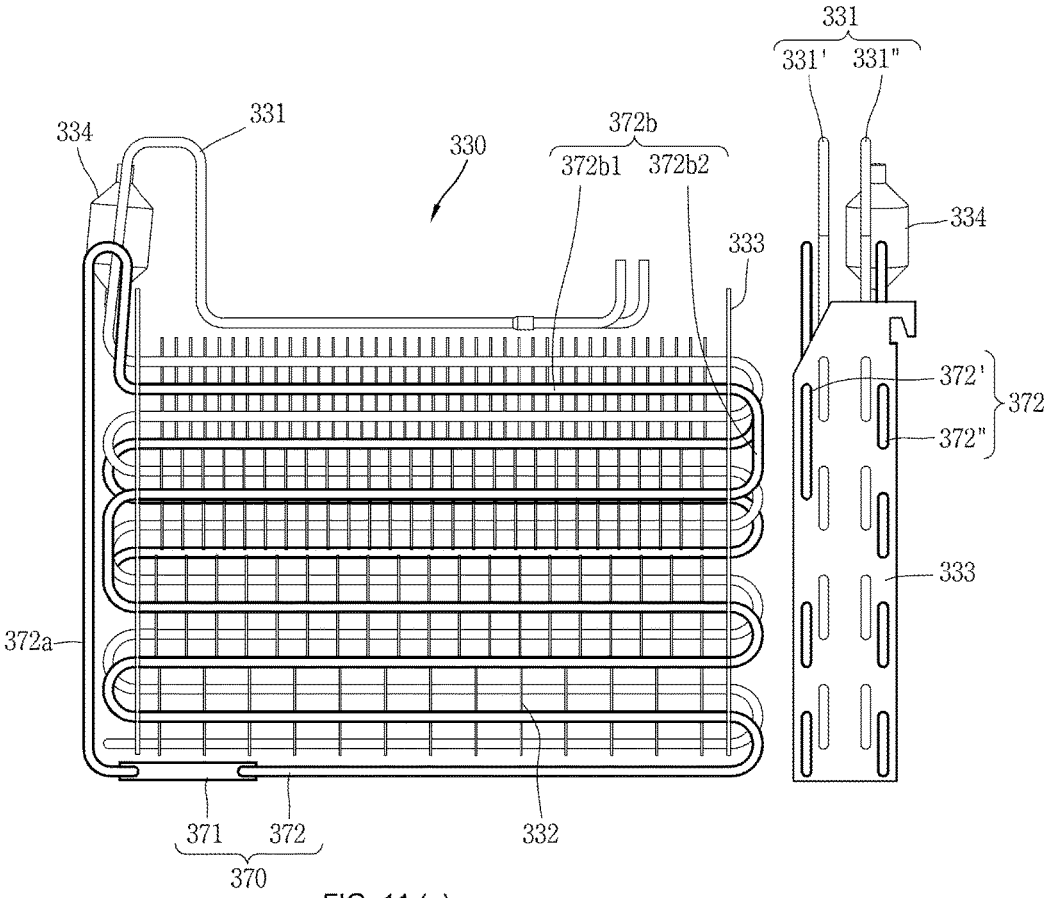
FIG. 11(*a*) and FIG. 11(*b*) are diagrams illustrating an example evaporator applied to the refrigerator of FIG. 1.
Figure 12:
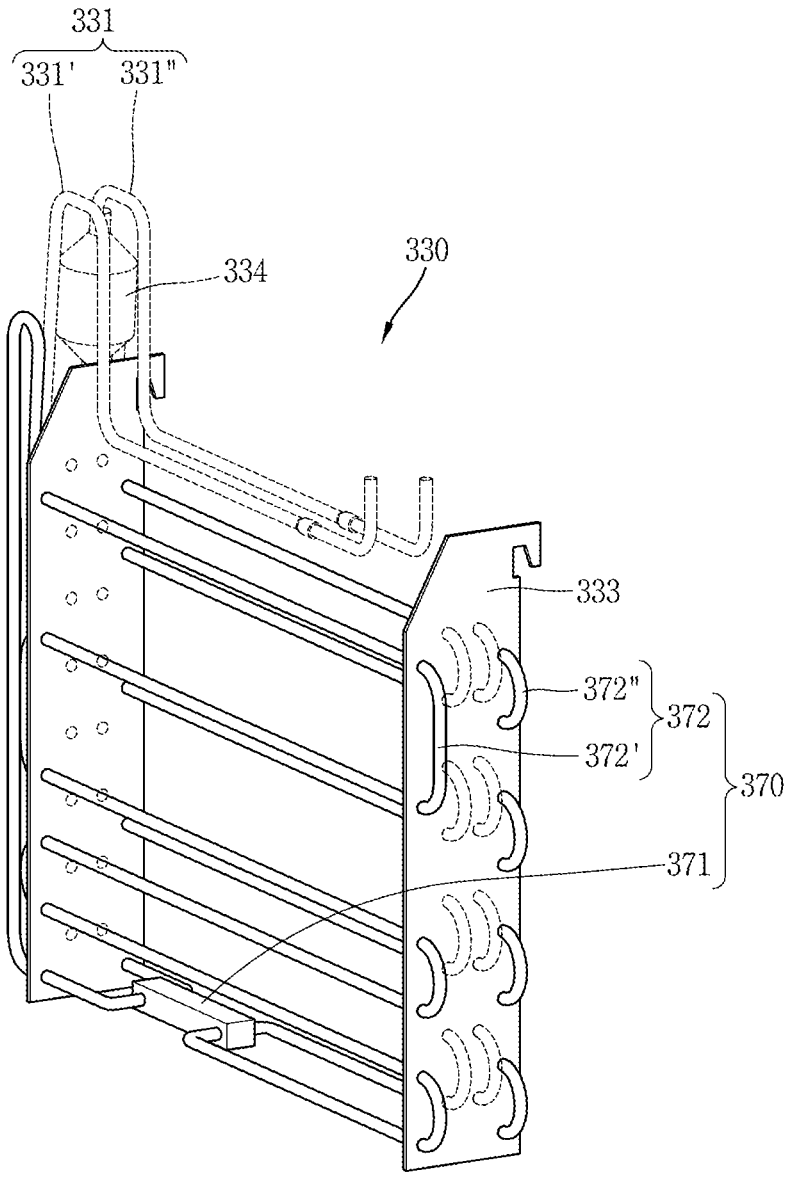
FIG. 12 is a conceptual view illustrating the layout of a first heat pipe and a second heat pipe in an evaporator illustrated in FIG. 11.

FIG. 11 is a front view (a) and a side view (b) illustrating a second embodiment of an evaporator 330 applied to the refrigerator 100 of FIG. 1, and FIG. 12 is a conceptual view illustrating the layout of a first heat pipe 371' and a second heat pipe 371" in the evaporator 330 illustrated in FIG. 11.

According to the present example, a total number of columns of the first heat pipe 372' disposed on a front portion of the evaporator 330 may be configured to be less than that of the second heat pipe 372". Here, the total number of columns denotes a total number of columns formed by a plurality of horizontal tubes 372*b*1 on a heat emitting part 372*b* constituting a heat pipe 372.

According to the foregoing structure, a path through which working fluid (F) circulates may be shorter to allow the temperature of the first and the second heat pipe 372', 372" to increase as a whole, and a total number of columns of the second heat pipe 372" may be larger than that of the first heat pipe 372' to transfer more heat to the second heat pipe 372".

On the present drawing, it is shown that the first heat pipe 372' is configured with total six columns and the second heat pipe 372" is configured with total eight columns. Specifically, in a state that the highest and the lowest column of the second heat pipe 372" are disposed to correspond to the highest and the lowest column of the first heat pipe 372', respectively, a distance between two columns adjacent to each other on the first heat pipe 372' is disposed to be larger than that between two columns adjacent to each other on the second heat pipe 372".

The adjoining two columns of the first heat pipe 372' may be provided at an upper portion of the first heat pipe 372'. According to the foregoing structure, a distance between the adjoining two columns at a lower portion of the first heat pipe 372' may be configured to be less than that at the upper portion.

It is a design considering convection according to the temperature of working fluid (F) when the working fluid circulates through the first heat pipe 372'. According to the foregoing structure, even when it is configured that a number of columns of the first heat pipe 372' is less than that of the second heat pipe 372", defrosting on a front portion of the evaporator 330 may be efficiently carried out by the effective layout of the first heat pipe 372'.

On the other hand, the present disclosure may not be necessarily limited to this. The highest column of the first heat pipe 172' may be disposed to be lower than the highest column of the second heat pipe 172" or the lowest column of the first heat pipe 172' may be disposed to be higher than the lowest column of the second heat pipe 172". In this case, a distance between two columns adjacent to each other on the first heat pipe 171' may be formed to correspond to (to be the same or similar to) that between two columns adjacent to each other on the second heat pipe 172".

What is claimed is:

1. A defrosting device, comprising:

a heating unit that is provided at a first side of an evaporator and that is configured to heat fluid passing through the heating unit, the heating unit comprising a heater case configured to receive the fluid and a heater coupled to the heater case and configured to heat the fluid in the heater case; and a plurality of heat pipes that are coupled to the heater case, that are disposed adjacent to a cooling tube of the evaporator, and that are configured to provide heat from the fluid to the cooling tube, wherein the fluid passes through each of the plurality of heat pipes and is heated by the heater, the plurality of heat pipes comprising:

a first heat pipe that is disposed adjacent to a first portion of the evaporator and that includes a plurality of first column portions, and a second heat pipe that is disposed adjacent to a second portion of the evaporator and that includes a plurality of second column portions, wherein a length of the first heat pipe is different from a length of the second heat pipe, and wherein a number of the plurality of first column portions is different from a number of the plurality of second column portions.

2. The defrosting device of claim 1, wherein the number of the plurality of second column portions is smaller than the number of the plurality of first column portions.

3. The defrosting device of claim 2, wherein the plurality of first column portions are evenly spaced and the plurality of second column portions are evenly spaced, and wherein a distance between adjacent second column portions of the plurality of second column portions is larger than a distance between adjacent first column portions of the plurality of first column portions.

4. The defrosting device of claim 2, wherein the plurality of first column portions are evenly spaced and the plurality of second column portions are evenly spaced, and wherein a distance between adjacent second column portions of the plurality of second column portions is substantially the same as a distance between adjacent first column portions of the plurality of first column portions.

5. The defrosting device of claim 1, wherein the number of the plurality of first column portions is smaller than the number of the plurality of second column portions.

6. The defrosting device of claim 5, wherein the plurality of first column portions are evenly spaced and the plurality of second column portions are evenly spaced, and wherein a distance between adjacent first column portions of the plurality of first column portions is larger than a distance between adjacent second column portions of the plurality of second column portions.

7. The defrosting device of claim 5, wherein the plurality of first column portions are evenly spaced and the plurality of second column portions are evenly spaced, and wherein a distance between adjacent first column portions of the plurality of first column portions is substantially the same as a distance between adjacent second column portions of the plurality of second column portions.

8. The defrosting device of claim 1, wherein the heater case comprises:

an interior space, a plurality of inlets, each of the plurality of inlets being respectively coupled to each of the plurality of heat pipes, and a plurality of outlets, each of the plurality of outlets being respectively coupled to each of the plurality of heat pipes.

9. The defrosting device of claim 8, wherein the heater comprises:

a base plate that includes ceramic materials and that is coupled to the heater case;

a heating element comprising a resistor located at the base plate and configured to generate heat using electric power; and a terminal that is located at the base plate and that is configured to electrically couple the heating element to a power source.

10. The defrosting device of claim 9, wherein the heater case includes:

an active heating portion that is coupled to the heating element, and a passive heating portion that is not coupled to the heating element, the passive heating portion including the plurality of inlets.

11. The defrosting device of claim 8, wherein the heater is coupled to a first surface of the heater case and the heater case includes:

a first extension fin that is extended from the first surface of the heater case and that covers a first side of the heater, and a second extension fin that is extended from the first surface of the heater case and that covers a second side of the heater.

12. The defrosting device of claim 11, wherein a sealing member made of silicone is filled into a space between the first extension fin and the second extension fin to cover the first surface of the heater case and the heater.

13. The defrosting device of claim 12, wherein an insulating material is interposed between the heater and the sealing member.

14. The defrosting device of claim 1, wherein the heater case comprises:

an interior space, a plurality of inlets, each of the plurality of inlets being respectively coupled to each of the plurality of heat pipes, and a plurality of outlets, each of the plurality of outlets being respectively coupled to each of the plurality of heat pipes wherein the heater comprises:

an active heating portion that is located inside the heater case and that is a passive heating portion that is coupled to the active heating portion and that is heated by the active heating portion, and wherein a portion of the heater case corresponding to the passive heating portion of the heater includes the plurality of inlets.

15. The defrosting device of claim 14, wherein the active heating portion of the heater includes a heating element.

16. A refrigerator, comprising:

a refrigerator body including a compartment;

an evaporator including a cooling tube, the cooling tube configured to absorb heat from the compartment; and a defrosting device configured to provide heat to the cooling tube of the evaporator, the defrosting device comprising:

a heating unit provided at a first side of the evaporator and that is configured to heat fluid passing through the heating unit; and a plurality of heat pipes that are coupled to the heating unit, that are disposed adjacent to the cooling tube of the evaporator, and that are configured to provide heat from the fluid to the cooling tube, wherein the fluid passes through each of the plurality of heat pipes and is heated by the heating unit, the plurality of heat pipes comprising:

a first heat pipe that is disposed adjacent to a first portion of the evaporator, and a second heat pipe that is disposed adjacent to a second portion of the evaporator, wherein a length of the first heat pipe is different from a length of the second heat pipe, wherein the heating unit comprises:

a heater case including:

an interior space, a plurality of inlets, each of the plurality of inlets being respectively coupled to each of the plurality of heat pipes, and a plurality of outlets, each of the plurality of outlets being respectively coupled to each of the plurality of heat pipes; and a heater including:

an active heating portion that is located inside the heater case and that is configured to generate heat for heating the fluid, and a passive heating portion that is coupled to the active heating portion and that is heated by the active heating portion, and wherein a portion of the heater case corresponding to the passive heating portion of the heater includes the plurality of inlets.

* * * * *